US006242868B1

(12) United States Patent
Green et al.

(10) Patent No.: US 6,242,868 B1
(45) Date of Patent: Jun. 5, 2001

(54) GLOW DISCHARGE APPARATUS HAVING DIRECT PRODUCTION OF VISIBLE LIGHT FROM NEON OR XENON

(75) Inventors: Ian Macdonald Green, London; Andrew Parkes, Biggleswade, both of (GB)

(73) Assignee: Central Research Laboratories Limited, Middlesex (GB)

( * ) Notice: Subject to any disclaimer, the term of this patent is extended or adjusted under 35 U.S.C. 154(b) by 0 days.

(21) Appl. No.: 09/202,353

(22) PCT Filed: Jun. 11, 1997

(86) PCT No.: PCT/GB97/01576

§ 371 Date: Mar. 25, 1999

§ 102(e) Date: Mar. 25, 1999

(87) PCT Pub. No.: WO97/48122

PCT Pub. Date: Dec. 18, 1997

(30) Foreign Application Priority Data

Jun. 13, 1996 (GB) ..... 9612418

(51) Int. Cl.[7] ..... H05B 37/00
(52) U.S. Cl. ..... 315/248; 315/330; 315/344
(58) Field of Search ..... 315/248, 344, 315/291, 330

(56) References Cited

U.S. PATENT DOCUMENTS

| | | | |
|---|---|---|---|
| 3,227,927 | 1/1966 | Marrison . | |
| 3,350,602 | 10/1967 | Germeshausen et al. . | |
| 5,420,481 * | 5/1995 | Mccanney | 315/291 |

FOREIGN PATENT DOCUMENTS

| | | |
|---|---|---|
| 196 38 932 | 3/1997 | (DE) . |
| 0 607 633 | 7/1994 | (EP) . |
| 0 609 989 | 8/1994 | (EP) . |
| 60-020450 | 2/1985 | (JP) . |
| 60-020451 | 2/1985 | (JP) . |
| 1-294348 | 11/1989 | (JP) . |
| 8-096746 | 4/1996 | (JP) . |

* cited by examiner

*Primary Examiner*—David Vu
(74) *Attorney, Agent, or Firm*—Evenson, McKeown, Edwards & Lenahan, P.L.L.C.

(57) ABSTRACT

Glow discharge apparatus comprises a light-transmissive body (101) defining a cavity (102) containing neon or xenon gas. The glow discharge is powered by one or more electrodes (103) external to the cavity. The apparatus also comprises a secondary light source (104) for illuminating the neon gas to provide electrons in the cavity, thereby assisting discharge initiation in intermittent use, for example when controlled by a pulse time modulation drive circuit (107).

13 Claims, 2 Drawing Sheets

GLOW DISCHARGE APPARATUS HAVING DIRECT PRODUCTION OF VISIBLE LIGHT FROM NEON OR XENON

BACKGROUND AND SUMMARY OF THE INVENTION

This invention relates to glow discharge apparatus comprising a body at least part of which is at least partly light-transmissive, the body defining a cavity containing a gas, the glow discharge being powered by one or more drive electrodes external to the cavity, and a secondary light source for illuminating the gas to provide electrons in the cavity, thereby assisting discharge initiation in intermittent use.

Lamps employing such a discharge are often called "electrodeless" lamps, although electrodes for other purposes may be present in the cavity.

A known apparatus of this type disclosed in EP-A-0 607 633, which describes an electrodeless lamp having a fill comprising mercury vapour, and a layer of photoluminescent material. The photoluminescent material is used to convert the UV light produced by the glow discharge to visible light. Such lamps have the disadvantage that operation at low temperatures is not reliable due to the low vapour pressure of mercury. The efficiency of the lamp for visible light is also not as high as that possible if no photoluminescent material were necessary.

According to the invention there is provided a glow discharge apparatus as defined in the first paragraph above, characterised in that the gas predominantly comprises one of the group consisting of neon and xenon. This enables visible light to be directly produced without the problems provided by the presence of mercury and/or photoluminescent material. The use of noble gases in this application is surprising because it is generally acknowledged that such discharges are much more difficult to start in intermittent use than mercury based discharges. The inventors are not aware of any teaching that the provision of a secondary light source is advantageous for electrodeless discharges in any noble gas in the absence of mercury vapour.

The invention will now be described, by way of example only, with reference to the accompanying diagrammatic drawings, in which

DETAILED DESCRIPTION OF THE DRAWINGS

Figure 1:
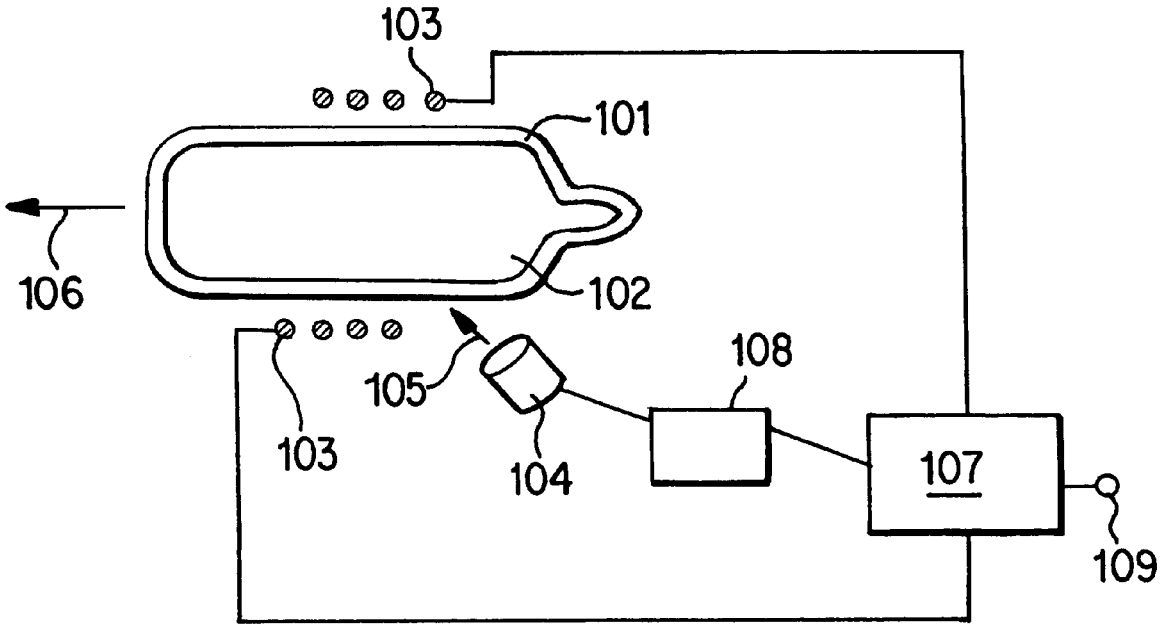
FIG. 1 shows glow discharge apparatus according to the invention.

In FIG. 1, a glow discharge apparatus comprises an at least partly light transmissive body (101), in the present example a transparent glass envelope, which defines a cavity (102) containing neon gas. In the present example the partial pressure of neon in the cavity is 2 Torr. The neon gas is preferably pure. As an alternative xenon gas may be used, or mixtures of either neon or xenon including a small quantity of argon or krypton (such as for example less than 5%, preferably 1%—known as a Penning mixture). Pure neon has produced more efficient light sources than the mixtures.

The apparatus is powered by an electrode (103) external to the cavity. In the present example this comprises a helical inductive coil having an inductance of 10 $\mu$H which surrounds part of the lamp, the helix having an axis parallel to the direction of emission of light (106) from the apparatus.

The apparatus further comprises a secondary light source (104) for illuminating the neon gas in the cavity with secondary light (105). In the present example this is a green light emitting diode such as that obtainable from Electrocomponent Limited and having a Ser. No. 826-587. In the present example the secondary light source is placed adjacent the light transmissive body and facing the cavity therein. A blue LED may be used as an alternative, or any other light source which produces suitably energetic photons and which has a sufficiently rapid response for the given application.

The external electrodes 103 are controlled by control means (107) having an input (109). This control means is also coupled to the secondary light source (104).

Figure 2:
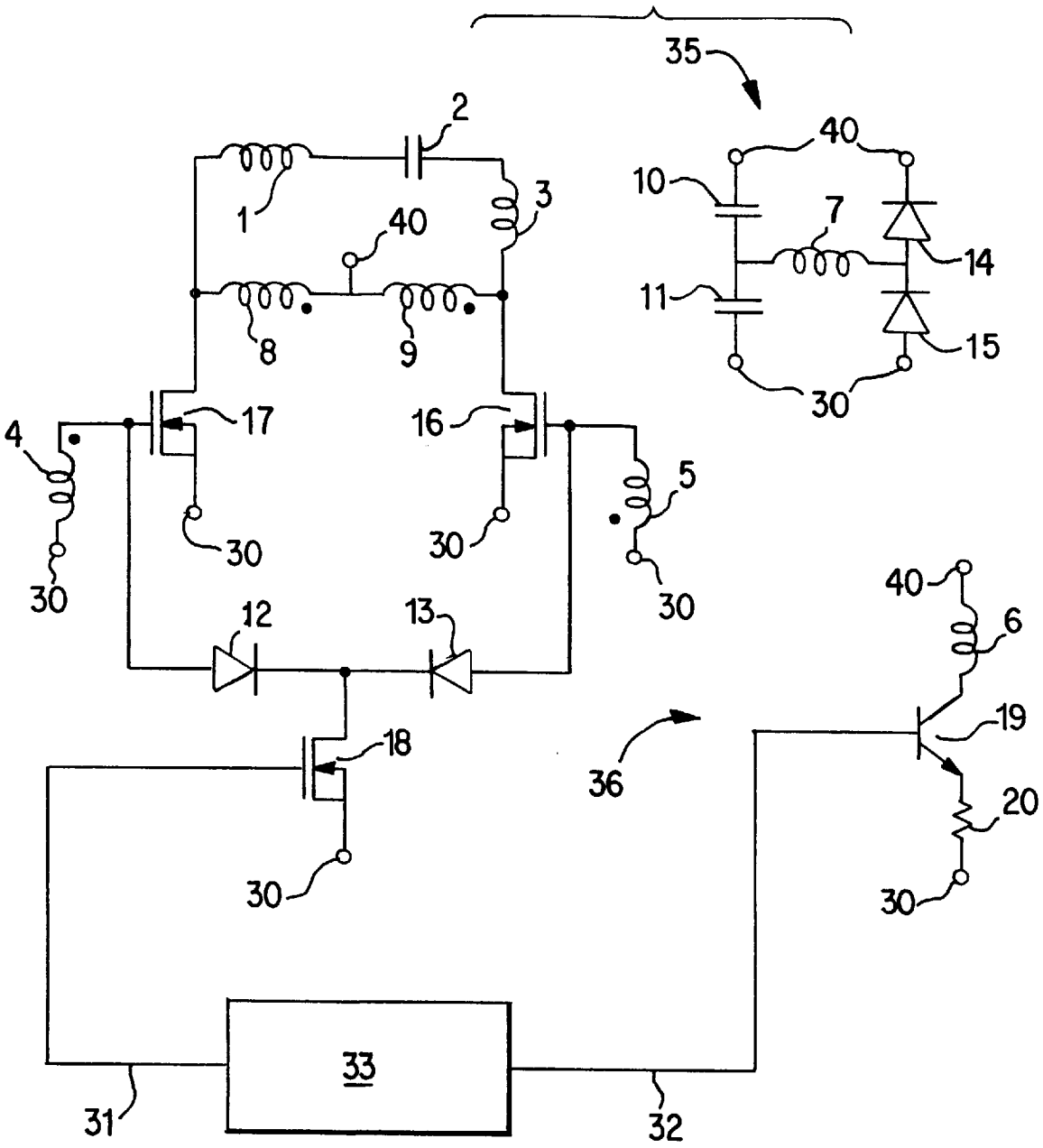
FIG. 2 shows a circuit diagram for powering the apparatus of FIG. 1.

In the present example, the external drive electrodes are powered by an oscillator as described in our co-pending International application W097/26705 which is incorporated herein by reference. A circuit diagram of the oscillator is shown in FIG. 2. The components shown in FIG. 2 are listed in table 1 below.

TABLE 1

| Reference Number | Component Type | Rating/Serial No. |
|---|---|---|
| 1 | Inductive Load | |
| 2 | Capacitor | 100 pf, 6 kV |
| 3 | Transformer (1) Winding | 1 turn |
| 4 | Transformer (1) Winding | 3 turns |
| 5 | Transformer (1) Winding | 3 turns |
| 6 | Transformer (1) Winding | 3 turns |
| 7 | Transformer (1) Winding | 3 turns |
| 8 | Transformer (2) Winding | 7 turns |
| 9 | Transformer (2) Winding | 7 turns |
| 10 | Capacitor | 47 nf |
| 11 | Capacitor | 47 nf |
| 12–15 | Diodes | BAT49 |
| 16–18 | FETs | IRLL 014 |
| 19 | Transistor | 2N2222 |
| 20 | Resistor | 5 ohms |

Transistors 16 and 17, together with adjacent components 2–11, 14 and 15 comprise the oscillator. Transistors 18 and 19, and components 12, 13 and 6, allow the oscillator to be turned on and off at will. Apart from that, the latter components take no part in the oscillation.

The component 1, as well as being an inductor, incorporates the load. In the present example it consists of a coil adjacent the light transmissive body. Current in 1 causes a gas discharge in the envelope to strike, resulting in the emission of light in operation. Power absorbed by the load causes component 1 to have a corresponding resistive component.

Components 1 and 2 are automatically driven very close to resonance by the phase shifts in the circuit, and thus define the operating frequency. Feedback involves the reactive component, capacitor 2, which feeds a current through reactive winding 3, which in turn couples to 4, 5 and 7. The two transformers shown (one comprising windings 3–7, the other of windings 8 and 9) were bi-filar wound on 9.4 mm o.d. toroids of 4C65 ferrite, manufactured by Philips. Other reactive components in the feedback loop are the input capacitance of transistors 16 and 17, and the magnetising inductance of the transformer having windings 3–7.

Diodes 14 and 15 conduct on each half cycle of the oscillation, and return oscillator energy to the power supply (the terminals labelled 30 in the Figure are connected to the zero volt output of a d.c. power supply (not shown) whilst the terminals labelled 40 are connected to the +12 volt output). This causes a phase shift in the gate wave forms. Diodes 14 and 15 have a subsidiary function in that, due to the transformer action of the transformer comprising components 3–7, they effectively limit the gate drive voltage to transistors 16 and 17, thus protecting the transistors. However, their primary function according to the invention is to provide a phase shift. Components 10, 11, 7, 14, and 15 comprise a diode clipper circuit 35 being inductively coupled to the oscillator.

On initial start up, before the oscillator has entered the large signal mode characterised by conduction of diodes 12 and 13, the circuit should oscillate at roughly the same frequency. This is ensured by arranging for the magnetising inductance of the first transformer (3–7) to resonate with the input capacitance of the two transistors 16, 17 at a frequency somewhat above the intended oscillator frequency. The exact value is not critical.

Transistor 19 allows the oscillator to be started controllably, by applying a positive going pulse of roughly 50 ns width to its gate. This injects current through 6, thereby causing one of transistors 16 or 17 to turn on. Other ways of starting the oscillator, such as biasing the gates of 16 and/or 17, will be obvious to one skilled in the art.

Transistor 18 allows the oscillator to be stopped controllably. By applying a positive level to the gate of 18, it turns on 18 and shorts the gates of transistors 16 and 17 to 0V.

This remote stop and start system is intended for lamp control, since controlling the on/off ratio of the oscillator, at a repetition rate of perhaps 200 Hz, conveniently controls the brightness. In practice the brightness can be varied over a range of at least 1000:1 using an appropriate pulse time modulation scheme. Control means 33 is provided to introduce electrical control signals to the oscillator when it is being used as part of such a pulse time modulation drive system for an electrodeless discharge lamp. Such signals from outputs 32 and 31 switch the oscillator on and off respectively as required.

Possible pulse time modulation schemes which may be used in the present example are described in WO 97/15172 which is incorporated herein by reference.

Oscillator frequencies in the range 1–20 MHz are preferred. Very preferably the frequencies lie in the range 5–15 MHz.

Figure 3:
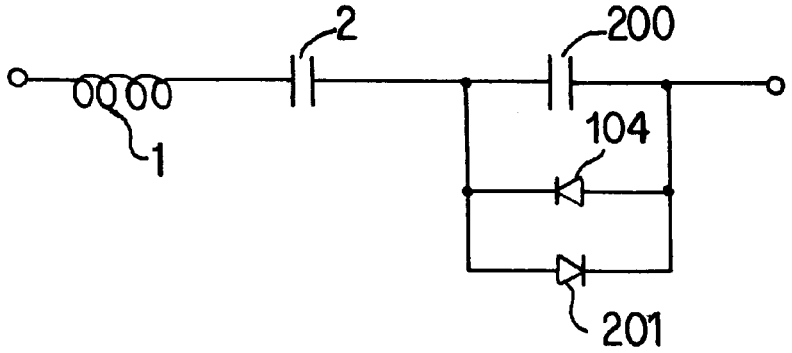
FIG. 3 shows a circuit for powering the secondary light source.

In the present example, the secondary light source is conveniently powered from the same oscillator as the discharge lamp. The arrangement used is shown in FIG. 3, which is connected into the circuit in place of components 1 and 2 in FIG. 2. Components 1 and 2 have the same values as before, but now an additional capacitor (200) having a value of 40 nF has been added in series with capacitor 2. The LED (104) comprising the secondary light source in the present example is connected in parallel with capacitor 200. An additional diode (201) is connected in anti parallel with the LED to carry the reverse current.

In operation, the voltage across the capacitor 2 in FIG. 1 is above 3.5 kV peak to peak when the circuit is first switched on and before the lamp discharge has struck, falling to about 750 volts peak to peak whilst the discharge lamp is operating in the H glow regime in its normal running condition as described in WO 97/15172. For the same conditions the voltage drop across capacitor 200 will be 8.7 volts and 1.9 volts respectively.

The LED (104) will normally have a forward conducting voltage of about 3 volts and a reverse conducting voltage of about 1 volt. Thus peak to peak voltages of much less than (3+1)=4 volts will not produce light from the LED. Therefore, in the present example, before the discharge lamp strikes, the diode will pass much of the current through C1 above 4 volts and emit light. Later, once the lamp has started, the diode will not conduct or absorb energy significantly. The circuit arrangement described can pulse over 1 amp on start up.

A further reason for wanting to turn off the LED once the lamp has started is the transient pulse ratings are normally considerably higher than continuous ratings, and so a given diode can safely give out much more light under starting conditions.

It will be obvious to one skilled in the art that, should the current through capacitor 1 not be suitable for driving the diode, it can be adjusted either by a more complex capacitor arrangement, or by a transformer, or by a series resistor.

Although in the above example a cavity with a helical coil has been described, there are many other configurations which may be used as an alternative. As a further example, the cavity may comprise a substantially planar envelope powered by a spiral electrode facing a major surface thereof, as described in patent application number WO 95/07545. The at least partly light transmissive body may carry a luminescent layer if desired. The at least partly light transmissive body need not be wholly light transmissive as in the above example. It may for example comprise an opaque container having a window.

The glow discharge apparatus may comprise, for example, a light source or a plasma etching or deposition system or other glow discharge processing system where it is advantageous to have an aid to discharge initiation which is external to a sample chamber and which therefore cannot contaminate it. The glow discharge apparatus may also comprise a lamp for a vehicle such as a truck or car or aeroplane, or a hazard warning beacon for use for example in traffic lights or on tall structures to make them visible to air traffic, or on ships.

In addition to the gases described above, a small quantity (for example 0.5 micro Curie) of radioactive tritium may be added to the gas fill to improve the discharge ignition further in intermittent use. Such a lamp can achieve high brightness in less than 5 ms after the application of r.f. power, in contrast to the case of an incandescent lamp which may take of the order of 100 ms to achieve reasonable brightness. The difference in response time of the two lamp types implies over two meters shorter stopping distance at a speed of 80 kilometers per hour for a vehicle behind one in which the lamp of the present invention is used as a brake light in comparison with one using a conventional incandescent lamp..

Finally, the contents of the document from which the present application claims priority (GB 9612418.5), particularly the Figures and the abstract, are incorporated herein by reference.

What is claimed is:

1. Glow discharge apparatus comprising a body at least part of which is at least partly light-transmissive, the body defining a cavity containing a gas, the glow discharge being powered by one or more drive electrodes external to the cavity, and a secondary light source for illuminating the gas to provide electrons in the cavity, thereby assisting discharge initiation in intermittent-use, wherein the gas predominantly comprises one of the group consisting of neon and xenon, and wherein the glow discharge produces visible light directly from said one of said group consisting of neon and xenon.

2. Glow discharge apparatus as claimed in claim 1 in which the gas does not include one or more of the group consisting of cadmium, mercury, and compounds of cadmium or mercury.

3. Glow discharge apparatus as claimed in claim 2 in which the gas includes less than 5% of one or more of the group consisting of argon or krypton.

4. Glow discharge apparatus as claimed in claim 2 in which the gas includes tritium.

5. Glow discharge apparatus as claimed in claim 2 further comprising pulse time modulation drive means (107).

6. Glow discharge apparatus as claimed in claim 1 in which the gas further includes less than 5% of one or more of the group consisting of argon or krypton.

7. Glow discharge apparatus as claimed in claim 6 in which the gas includes tritium.

8. Glow discharge apparatus as claimed in claim 6 further comprising pulse time modulation drive means (107).

9. Glow discharge apparatus as claimed in claim 1 in which the gas includes tritium.

10. Glow discharge apparatus as claimed in claim 9 further comprising pulse time modulation drive means (107).

11. Glow discharge apparatus as claimed in claim 1 further comprising pulse time modulation drive means (107).

12. A vehicle lamp comprising glow discharge apparatus as claimed in claim 1.

13. A hazard beacon comprising a glow discharge apparatus as claimed in claim 1.

* * * * *